US006152693A

United States Patent [19]

Olsen et al.

[11] Patent Number: 6,152,693

[45] **Date of Patent: *Nov. 28, 2000**

[54] FOLDING PROPELLER

[75] Inventors: Steen Christian Olsen, Fredericia; Sune Ehrenskjöld, Kolding, both of Denmark

[73] Assignee: Gori Marine AS, Kolding, Denmark

[ * ] Notice: This patent issued on a continued prosecution application filed under 37 CFR 1.53(d), and is subject to the twenty year patent term provisions of 35 U.S.C. 154(a)(2).

[21] Appl. No.: 08/666,338

[22] PCT Filed: Dec. 23, 1994

[86] PCT No.: PCT/DK94/00490

§ 371 Date: Nov. 18, 1996

§ 102(e) Date: Nov. 18, 1996

[87] PCT Pub. No.: WO95/17331

PCT Pub. Date: Jun. 29, 1995

[30] Foreign Application Priority Data

Dec. 23, 1993 [DK] Denmark ..... 1450/93

[51] Int. Cl.[7] ..... F04D 29/26

[52] U.S. Cl. ..... 416/87; 416/142

[58] Field of Search ..... 416/87, 88, 89, 416/142, 143

[56] References Cited

U.S. PATENT DOCUMENTS

| | | | |
|---|---|---|---|
| D. 141,235 | 5/1945 | Birsh | 416/87 |
| 3,589,647 | 6/1971 | Burkham | 416/89 |
| 4,364,711 | 12/1982 | Brandt et al. | 416/142 |
| 4,768,927 | 9/1988 | Munk | 416/87 |
| 4,801,243 | 1/1989 | Norton | 416/89 |

FOREIGN PATENT DOCUMENTS

| | | | |
|---|---|---|---|
| 2300812 | 7/1974 | Germany . | |
| 3101272 | 12/1981 | Germany . | |
| 26090 | of 1909 | United Kingdom | 416/87 |
| WO 91/06468 | 5/1991 | WIPO . | |
| WO 93/01972 | 2/1993 | WIPO . | |

*Primary Examiner*—John Kwon

*Attorney, Agent, or Firm*—Jacobson, Price, Holman & Stern, PLLC

[57] ABSTRACT

A propeller (1) for commercial vessels as well as sailing ships with an auxiliary engine, having a hub (2) and at least two propeller blades (1) which are pivotally mounted in the hub (2). The blades (1) are pivotable between unfolded operating positions and at least one passive position in which the shaft does not rotate, and the blades extend axially rearwardly in extension of the hub (2). The blades (1) are moveover adapted to pass each other in said passive position. In the passive position, the blades (1) extend axially away from the hub (2) with the same side edge (15) of the two side edges (14, 15) of the blades facing each other. The propeller can hereby have either the front edge (14) of the blades or the rear edge (15) of the blades as the leading one so that the propeller can operate in ordinary gear or in "low gear" thereby enabling optimal efficiency in several operating situations. Further, the propeller offers minimal water resistance in the passive position.

9 Claims, 13 Drawing Sheets

Figure 1:
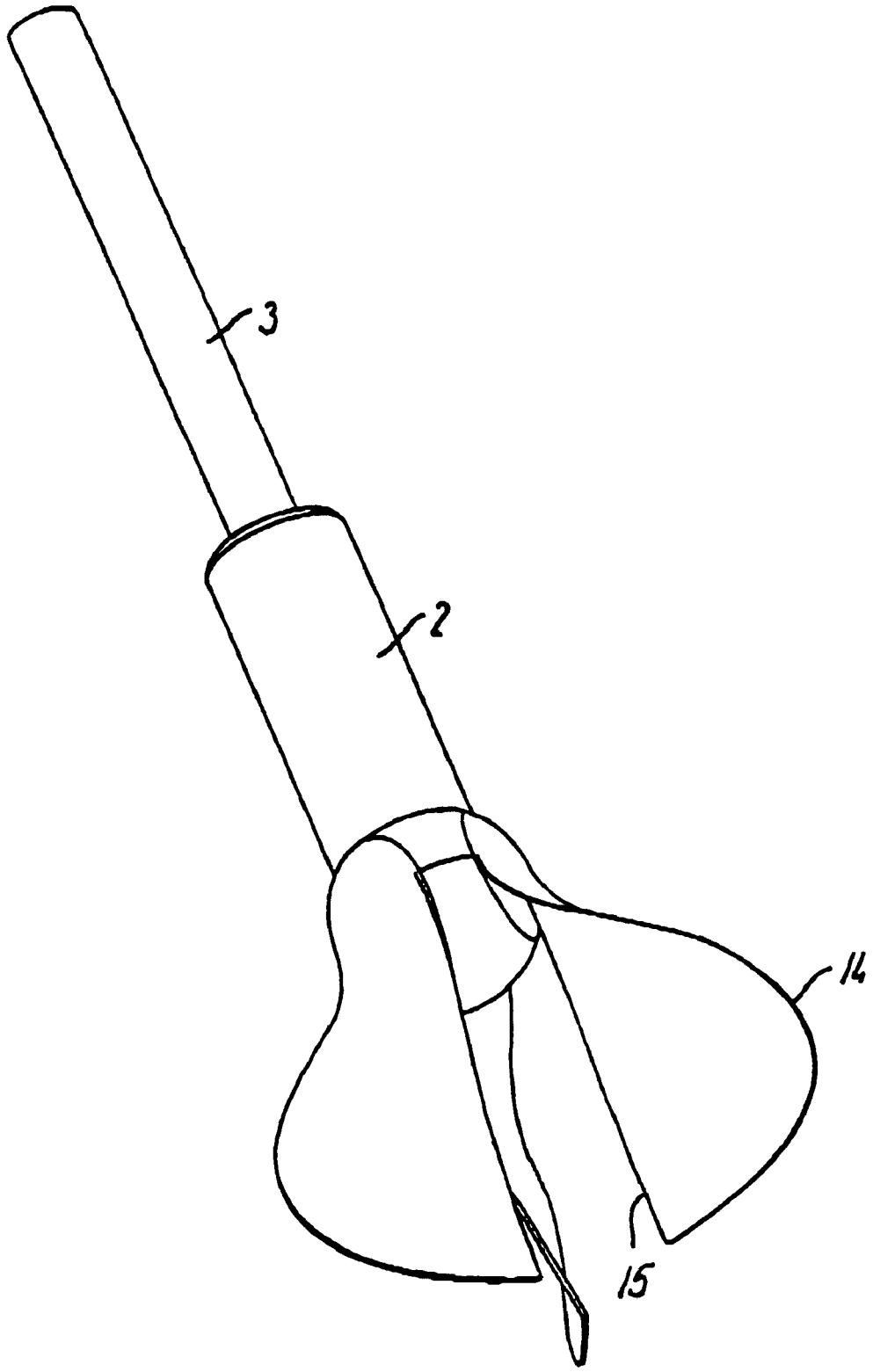

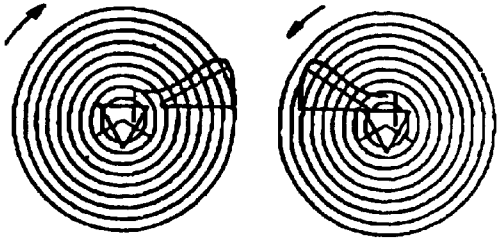
FIG.13e
FIG.13d
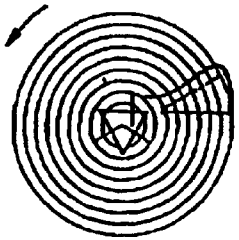
FIG.13c
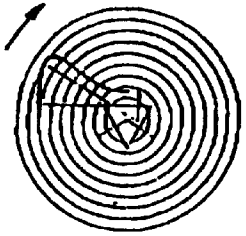
FIG.13b
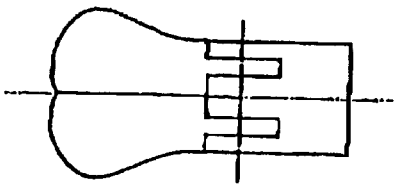
FIG.13a
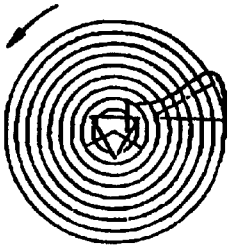
FIG.14c
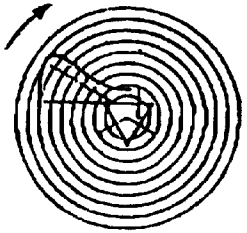
FIG.14b
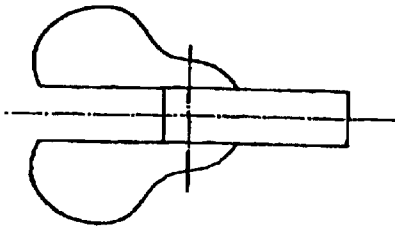
FIG.14a

FOLDING PROPELLER

The invention concerns a folding propeller having a hub and at least two propeller blades which are pivotally mounted in the hub about pivot axes extending radially outwardly from a central area in the hub, said blades being pivotable about their pivot axes between unfolded, radially protruding operating positions in which the propeller during rotation propels the ship through the water, and one passive position in which the shaft does not rotate, and in which the blades extend axially rearwardly in extension of the hub, said blades being adapted to pass each other in said passive position.

The folding propellers used in practice are unique in presenting a very low water resistance when a sailing ship sails forwardly with the engine stopped. The folding propellers have blades which are mounted pivotally in the hub in such a manner that they are unfolded by the centrifugal force to an active position in which the propeller drives the ship through the water when the shaft rotates, and are folded together by the water pressure to a passive position with minimal water resistance when the ship is under sail with the engine stopped, in which position the blades extend rearwardly in extension of the hub.

The folding propeller may be designed with the correct pitch distribution, but the blade weight must be carefully adapted to be able to keep the propeller open when sailing astern. The most popular folding propellers have just two blades, which makes it difficult to obtain a sufficiently large blade area and thus thrust for larger vessels, since the blades will hereby be excessively big and heavy.

U.S. Pat. No. 4,364,711 discloses a two-bladed folding propeller of the type mentioned in the opening paragraph, in which the blades in said passive position extend axially away from the hub with the front side edge of one blade positioned opposite the rear side edge of the other blade, and vice verse, as is also the case in the conventionally used two-bladed folding propellers when the blades are folded together in the passive position. In the propellers of the US document the hub is rotatably mounted on the shaft, so that a transmission mechanism arranged in the hub causes the blade to unfold when the propeller shaft begins to rotate.

In contrast to the propeller known from the above-mentioned US patent Specification, the folding propellers used in practice do not have the front edge of the blade, but the rear edge as the leading one when sailing astern, causing the propellers used in practice to work with reduced efficiency.

Accordingly, there is need for a folding propeller which, in engine propelled navigation, may have the front edge of the blades as the leading one, no matter whether the ship sails ahead or astern, which has the correct pitch distribution and automatically assumes stable positions with an optimum propeller efficiency under the action of the hydrodynamic forces and the centrifugal force.

The novel folding propeller of the invention is characterized in that, in said passive position, all the blades extend axially away from the hub with the same side edge of the two side edges of the blades facing each other.

In said passive position, the blades, seen in a radial section, thus extend in directions radially outwards from the axis of rotation in such a manner that the blade cross-sections divide a circle into angles of equal sizes between them.

Where a two-bladed propeller is involved, the blade cross-sections extend radially outwards to their respective sides from the axis of rotation and preferably extend in extension of each other and thereby divide a circle into two angles of 180°.

Where a propeller having three blades is involved, the angles will be 120°, in case of four blades they will be 90°, and so for.

A special advantage of the invention is that it is possible to provide a folding propeller having three or more blades which is sufficiently compact for it to be used in practice.

In case of navigation ahead as well as astern the folding propeller of the invention may have either the front edge of the blades or the rear edge of the blades as the leading one, so that the propeller can operate either in ordinary gear or in "low gear". Thus, the propeller operates with optimal efficiency in all operating situations, while the propeller presents minimal water resistance when, with the engine stopped, it has assumed a position of rest. The propeller may hereby be used for sailing-boats as well as commercial boats where an additional "low gear" is needed.

In case of navigation ahead with the engine stopped, the blades will therefore be held together in a shape resembling the feathers of an arrow. With this shape the water resistance is minimal, and like the feathers of an arrow the blades have a stabilizing effect on the navigation. The shape is also useful for repelling seaweed, which otherwise tends to foul other propeller types.

In a typical basic structure according to the invention the axes of rotation of the propellers are at right angles to the propeller shaft and intersect it. When this orientation is varied, the diameter and pitch of the propeller may be adapted optimally to a given operating situation.

The ratio of pitch to propeller diameter of a propeller blade is an expression of the distance which the blade advances per rotation along its helical face in relation to the diameter. A change in this ratio may be compared with a low gearing (mall pitch) when the ship is to sail at slow speed under great resistance, and high gearing (great pitch) when it is to sail at a fast speed. Thus, gearing the propeller provides the additional advantage that the engine will rotate as best as possible within its economic operating range, even though the speed of propulsion is varied.

Figure 3:
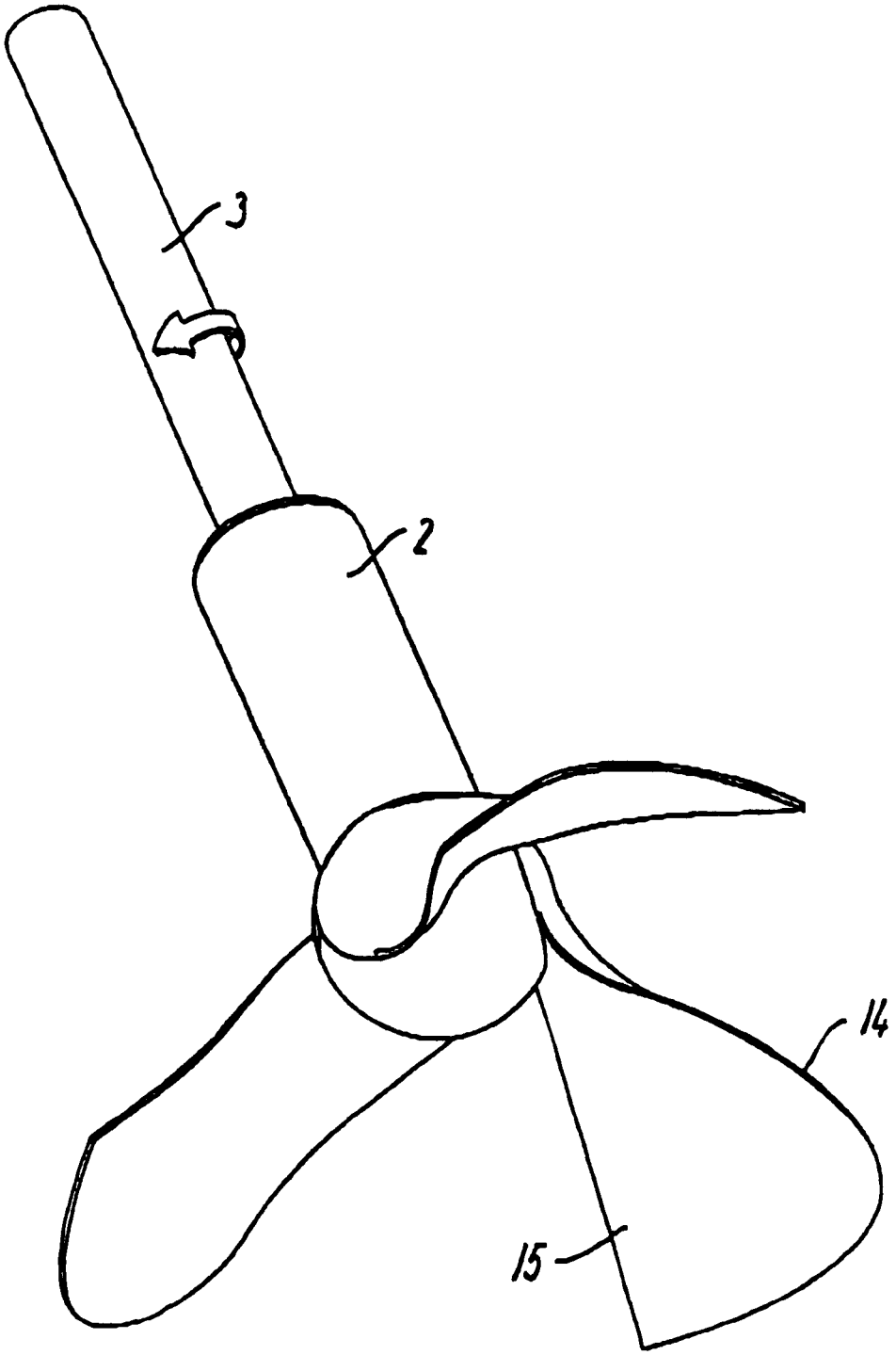
Figure 4:
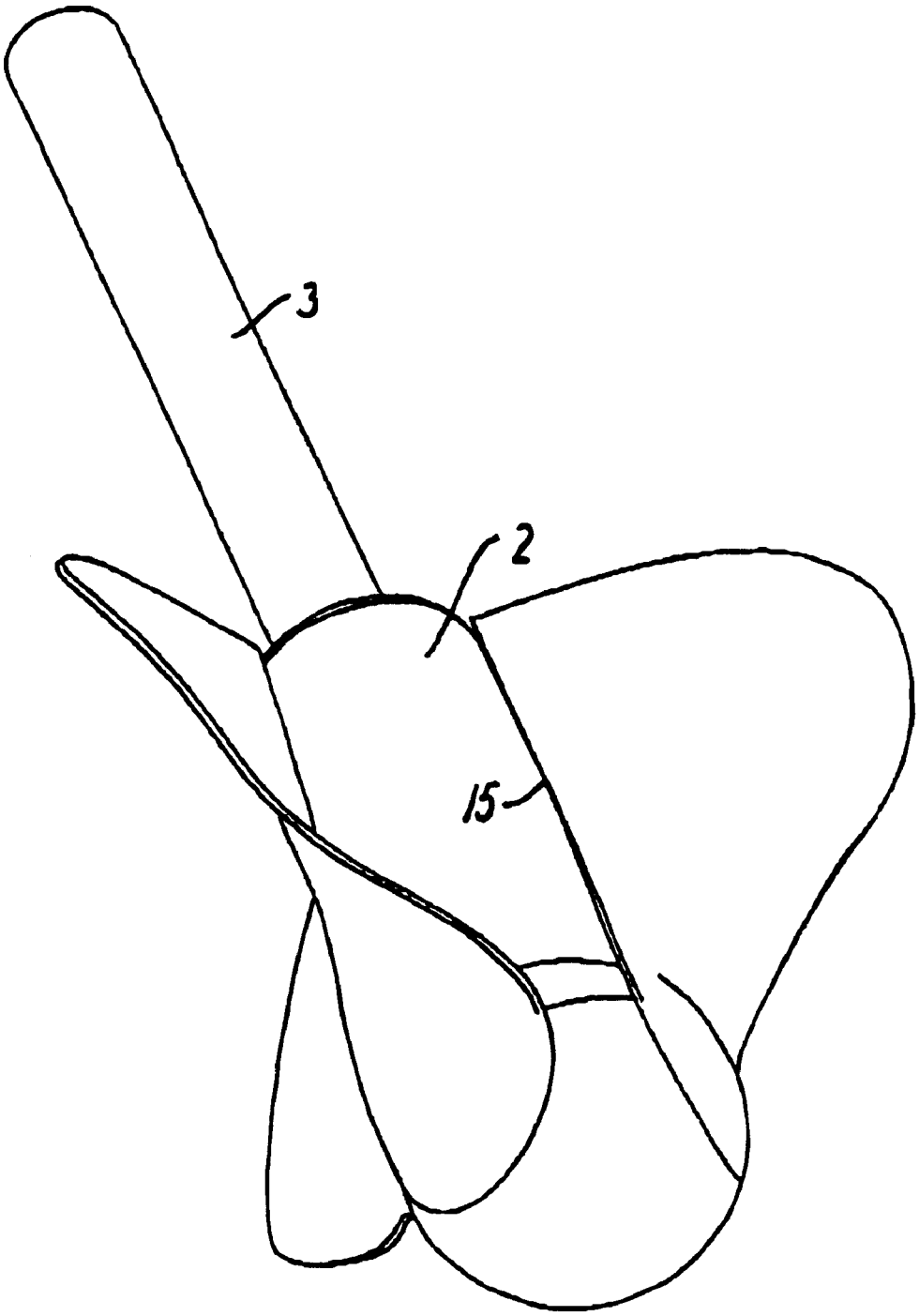
Figure 5:
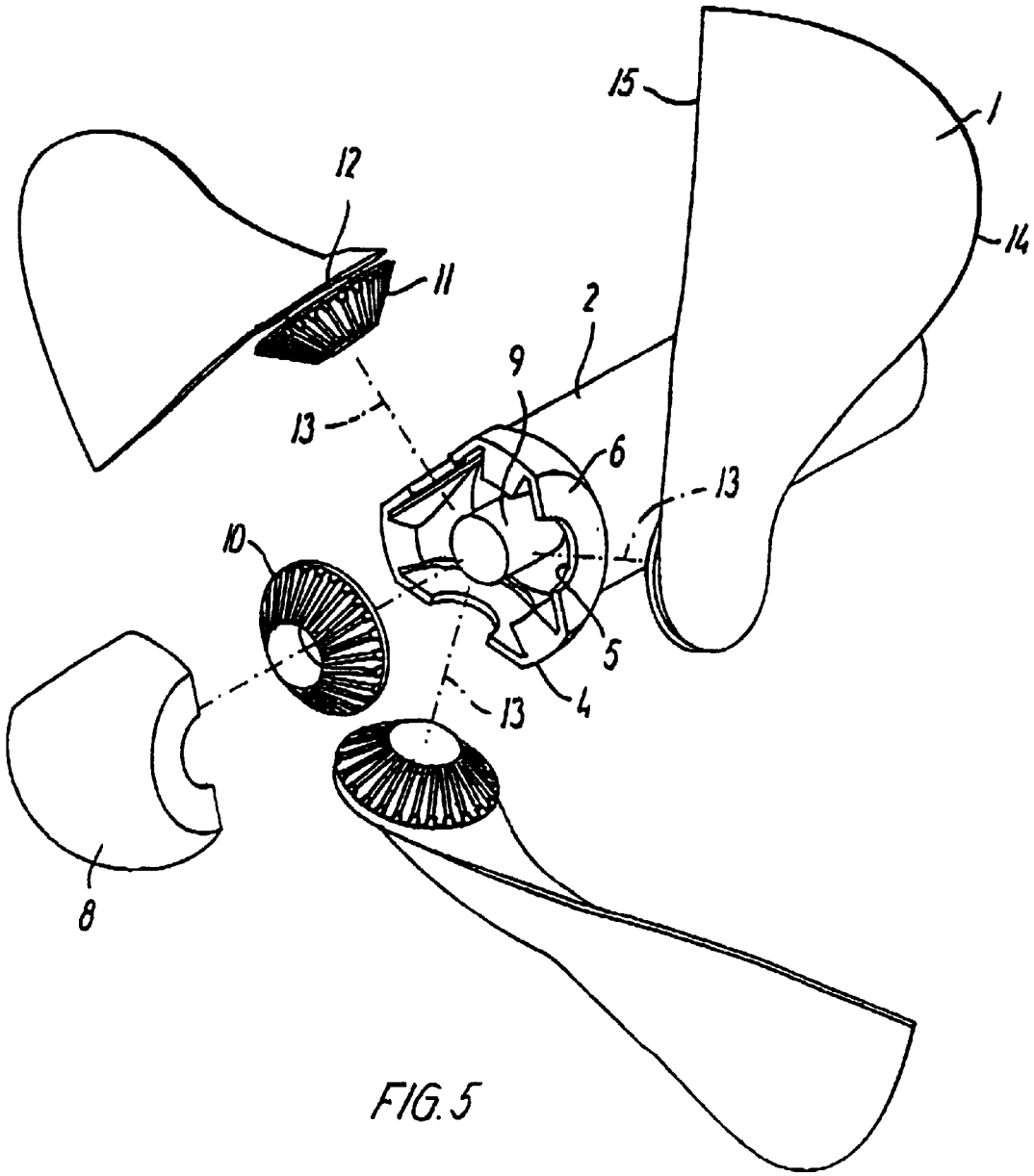
Figure 8:
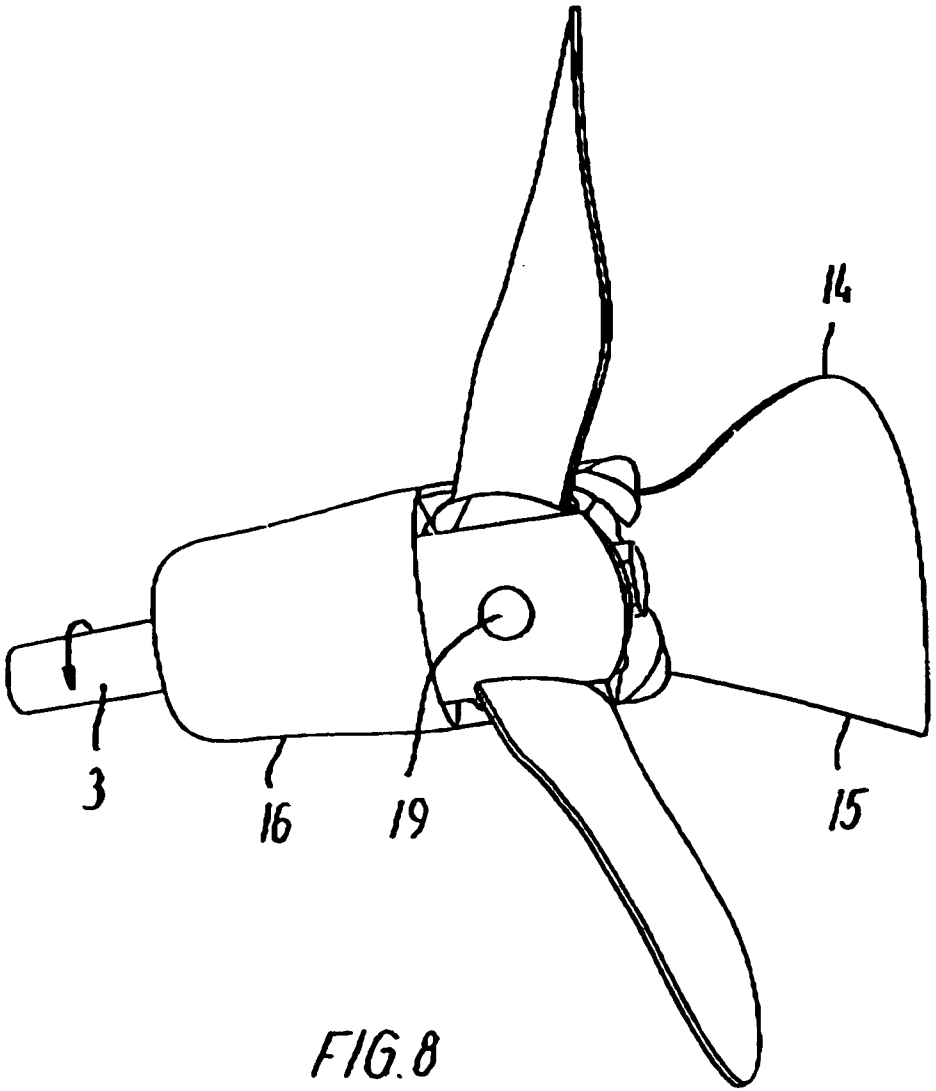
Figure 9:
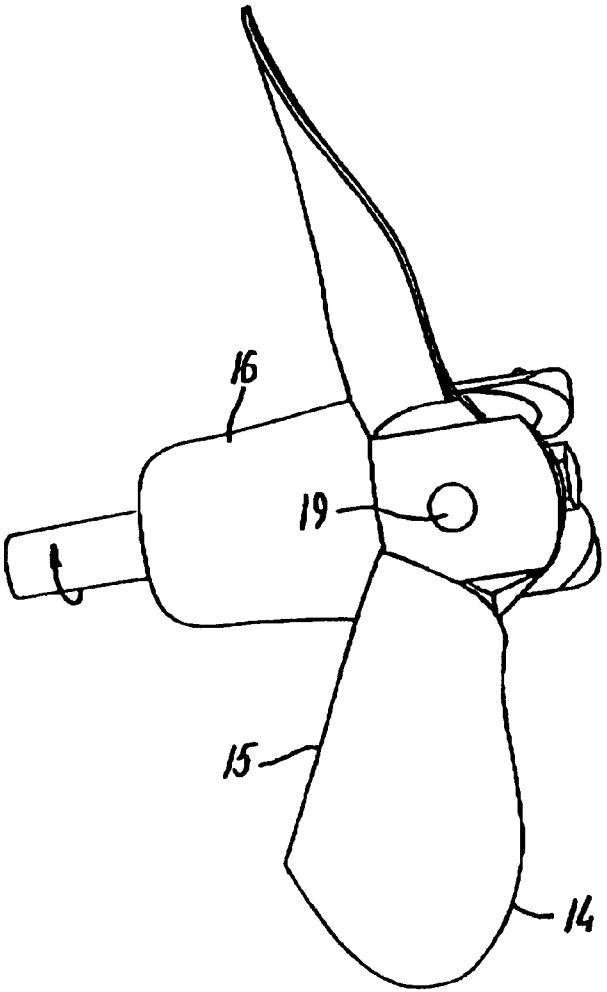
Figure 10:
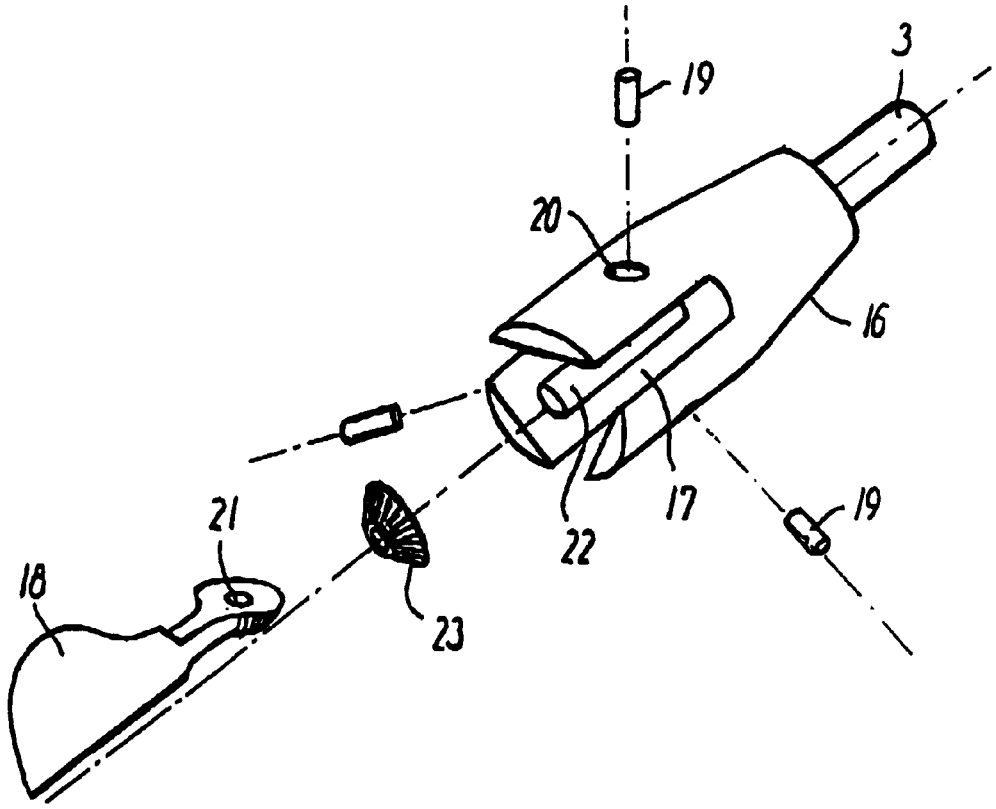
Figure 11E:
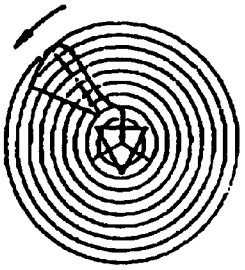
Figure 11D:
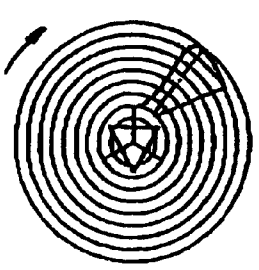
Figure 11C:
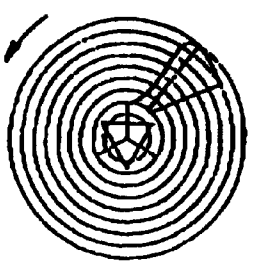
Figure 11B:
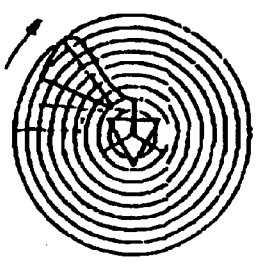
Figure 11A:
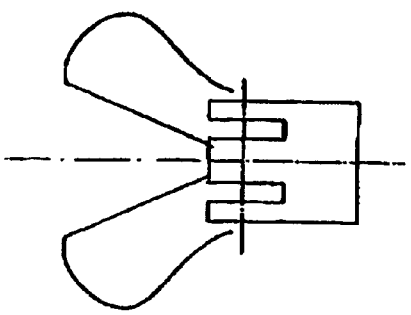
Figure 12C:
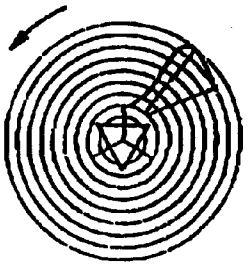
Figure 12B:
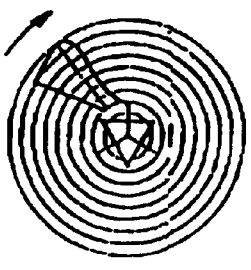
Figure 12A:
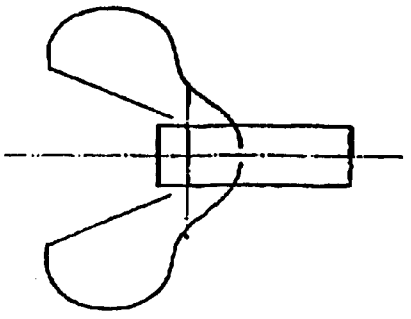
Figure 15E:
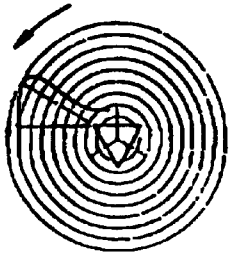
Figure 15D:
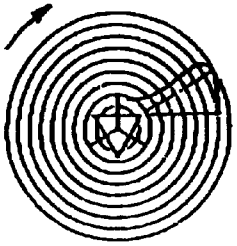
Figure 15C:
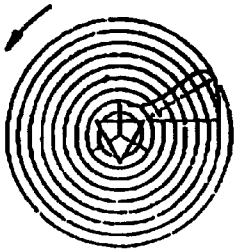
Figure 15B:
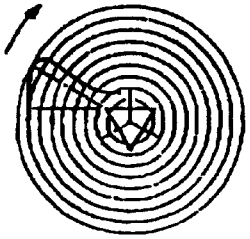
Figure 15A:
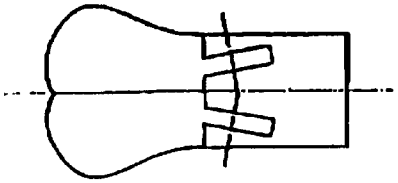
Figure 16C:
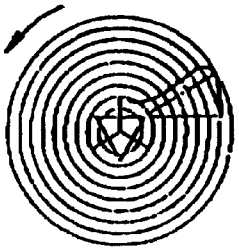
Figure 16B:
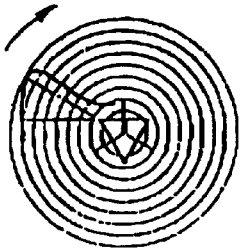
Figure 16A:
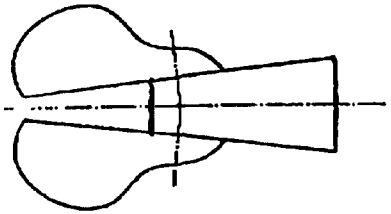

The manner in which the gearing may be determined by selecting the correct orientation of the pivot axes of the blades, is described more fully below together with other advantageous properties and effects of the invention with reference to the drawing, in which FIGS. 1–4 are a perspective view of a first embodiment of a propeller according to the invention in various operating positions, FIG. 5 is an exploded view of the same, FIGS. 6–9 show a second embodiment of a propeller according to the invention in various operating positions, FIG. 10 is an exploded view of the same, FIGS. 11*a–e* are a schematic view of a propeller having blades whose pivotal movement about their pivot axes is restricted, seen in typical operating positions, FIGS. 12*a–c* are a schematic view of a propeller having blades which can pivot freely about their pivot axes, seen in typical operating positions, FIGS. 13*a–e* are a schematic view of a propeller having blades whose pivotal movement about their pivot axes is restricted, seen in typical operating positions, FIGS. 14*a–c* are a schematic view of a propeller having blades which may pivot freely about their pivot axes, seen in typical operating positions, FIGS. 15*a–e* are a schematic view of a propeller having a conical hub and blades whose pivotal movement about their pivot axes is restricted, seen in typical operating positions, and FIGS. 16*a–c* are a schematic view of a propeller having a conical hub and blades which can pivot freely about their pivot axes, seen in typical operating positions.

FIGS. 1–4 show a first embodiment of a propeller according to the invention. The propeller, which is shown in exploded view in FIG. 5, comprises three propeller blades 1, which are pivotally mounted on a hub 2, which is in turn secured on a shaft 3 for a ship (not shown). As shown best by FIG. 5, the hub 2 expands downwardly in a bearing housing 4 having bearings 5 and bearing faces 6 for pivotal mounting of the propeller blades.

As shown in FIG. 5, the bearing housing is divided into two halves, one 7 of which constitutes a fixed component of the hub, while the other 8 is a cover that can be screwed on to the fixed component 7 to close the bearing housing 4. A central pin 9 for receiving a central conical gear wheel 10 is provided in the bearing housing 4 coaxially with the hub 2.

In this passive position all the blades 1 extend away from the hub 2 with the same side edge 15 of the two side edges 14, 15 of all the blades facing each other.

In the shown embodiment, it is the rear side edges 15 of the blades 1 that face each other and thus also the pivot axis, while the blade areas are disposed such that said side edges 15 are radially spaced from the pivot axis.

It should be mentioned for the sake of good order that a propeller blade 1 has front 14 and rear 15 side edges which are adapted to be the leading one and trailing one, respectively, during the passage of the blade through the water when optimal power of propulsion from the propeller is to be achieved.

The inner end of each propeller blade 1 is formed with a conical gear wheel part 11 complementary to the central conical gear wheel 10. The gear wheel part 11 is connected with the propeller blade 1 by means of a short pin or a connector 12 of a diameter corresponding to the diameter of the bearings 5 and a length corresponding to the thickness of the wall of the housing around the bearings 5.

Mounting of the propeller proceeds from the state where the bearing housing 4 is disassembled in its two halves. First the central conical gear wheel 10 is pushed into position over the central pin 9, and then the short pins 12 on each blade 1 are pushed into the half-bearings 5 in the fixed component 7 of the housing with the rear sides of the conical gear wheel parts 11 engaging the inner side of the wall of the housing around the bearings 5 and the opposite side of the end part of the propeller blades 1 engaging the respective bearing faces 6. Finally, the cover 8 is screwed into position on the fixed component 7 of the housing, thereby fixing the blades pivotally in the bearings 5 with all three conical gear wheel parts 11 in common mesh with the central conical gear wheel 10. The blades hereby synchroneously follow the pivotal movement of one another.

As will be seen, in this embodiment the blades may pivot freely around their pivot axes 13 which are determined by the pins 12. Each of the blades has a front edge or leading edge 14 and a rear edge 15. The blade shape of the folding propeller is elongate with a mass centre of gravity at a relatively great distance from the pivot axis 13, so that the blades, in the unfolded position, are affected by a considerable centrifugal force to keep the blades unfolded against the action of the simultaneously acting hydrodynamic forces.

In the situation shown in FIG. 1 the ship (not shown) sails ahead without rotation of the propeller shaft. The pressure from the passing flow of water hereby drives the propeller blades rearwardly to a position in which the blades extend axially rearwardly in extension of the hub, and in which the blades offer a minimal water resistance.

Figure 2:
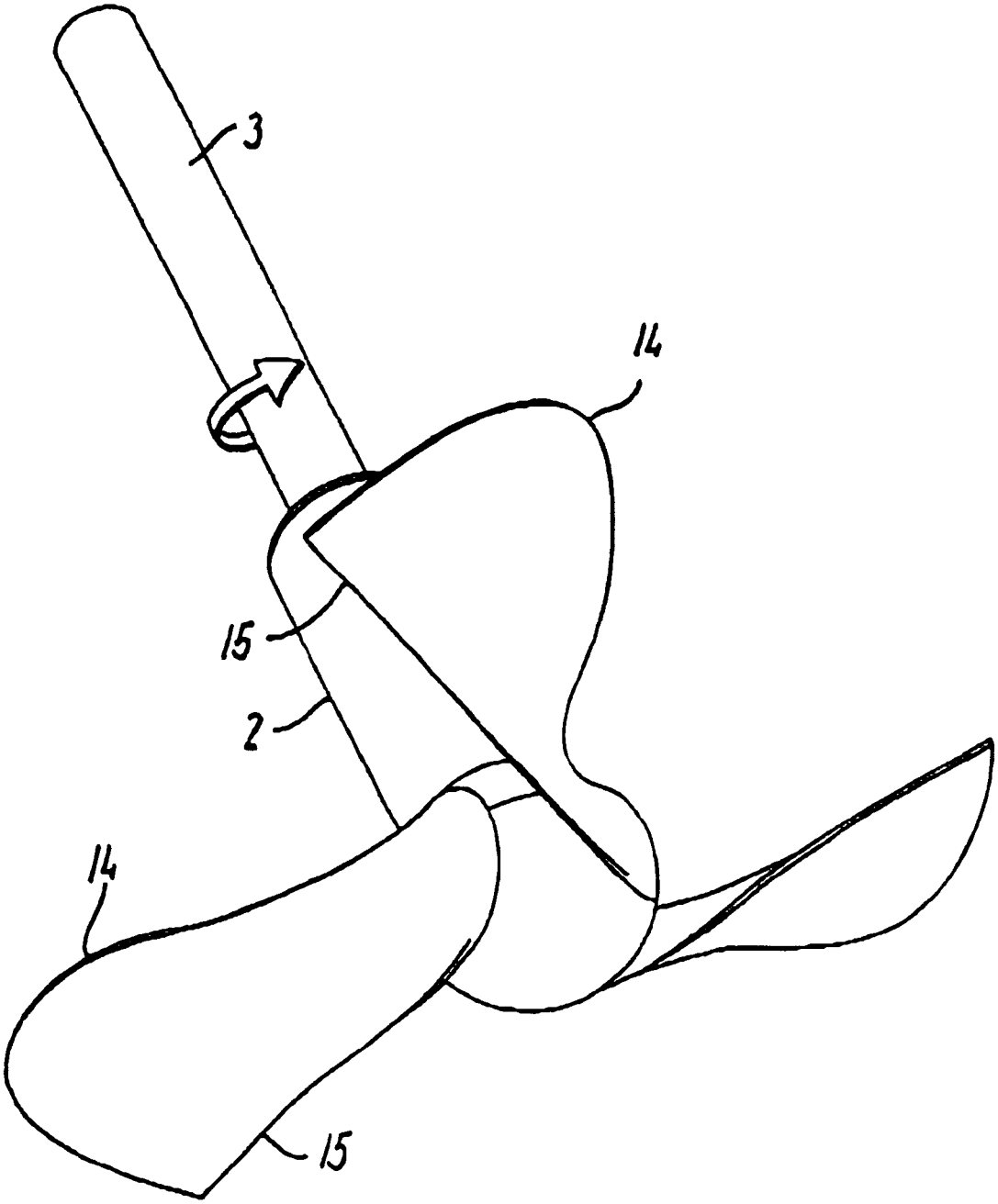

When the ship is to be propelled ahead by power, the propeller shaft is caused to rotate in the direction shown by the arrow in FIG. 2. The blades are hereby affected by a centrifugal force which however—in contrast to conventional folding propellers—does not essentially cause the blades to unfold in the rearwardly extending blade position shown in FIG. 1, but is instead absorbed a moment in the bearings 5 and the bearing faces 6. The blades would therefore tend to remain in said position, if they wore not affected by another force which is caused by the inherent inertia of the blades and the inertia of the surrounding water.

The inertia has the effect that the blades are not readily carried along in the rotation in unchanged position, but instead perform a pivoting rearward movement opposite the rotation so that the blades begin to open. As soon as this has taken place, the centrifugal forces begin to cause the blades to unfold further until the blades assume the unfolded position shown in FIG. 2, in which the blades are balanced under the combined action of the centrifugal forces and the hydrodynamic forces. In this position, the propeller propels the ship through the water with the front edge 14 as the leading edge.

When the ship is to sail astern, the axis of rotation of the propeller shaft 3 is turned, so that the propeller instantaneously again assumes the position of rest shown in FIG. 1, since the ship will continue its propulsion in the water for a while more. Immediately thereafter the propeller shaft begins to rotate in the opposite direction of rotation shown in FIG. 3, whereby the blades begin to open rearwardly with respect to the shown direction of rotation.

As will be seen, this structure of the invention involves the remarkable advantage over conventional folding propellers that the front edge 14 is now also the leading edge in the astern position. The propeller can therefore work with optimal efficiency in both ahead and astern.

For switching to navigation ahead again, the direction of rotation of the propeller is reversed once more, whereby it will momentarily stand still, while the ship continues sailing astern. The blades are hereby folded, as shown in FIG. 4, with the rear edges 15 inwardly toward the hub in the opposite direction of the position shown in FIG. 1.

As soon as the blades have passed the position of rest shown in FIG. 4 and begin to rotate in the direction of rotation shown in FIG. 2, the blades are opened again in a rearward direction with respect to the direction of rotation and are folded out to the position shown in FIG. 2, in which the propeller again operates with the front edge 14 as the leading edge a propels the ship forwardly.

As will be seen, this will always be the case, irrespective of the number of switching between sailing ahead and astern. This favourable effect is brought about by the fact that the blades can turn 360° about their axes and assume two axial positions which the blades assume automatically when the ship sails ahead or astern, respectively, with the propeller stopped.

The second embodiment of the propeller of the invention shown in FIGS. 6–10 differ from the first embodiment in that the pivot angle of the blades is limited. In this embodiment the propeller has a hub 16 which is secured to the propeller shaft 3. The hub is formed with three guide grooves 17 for receiving the inner end of three propeller blades 18. The blades are mounted swingably in the hub by means of pivots 19, which determine the radial pivot axes of the blades, and which extend through radially extending holes 20 in the hub and corresponding holes 21 in the propeller blade. A central pin 22 for receiving a central conical gear wheel 23 is arranged co-axially in the hub. Corresponding conical gear wheel parts or toothed portions 24 are provided at the end of ach propeller blade 18, said gear wheel part or toothed portions engaging the central conical gear wheel 23 when the propeller is mounted. As will be seen, this second embodiment of the propeller of the invention operates in exactly the same manner as the embodiment shown in FIGS. 1–5, except that the propeller is restricted in its pivotal movement about the pivots 19.

Figure 6:
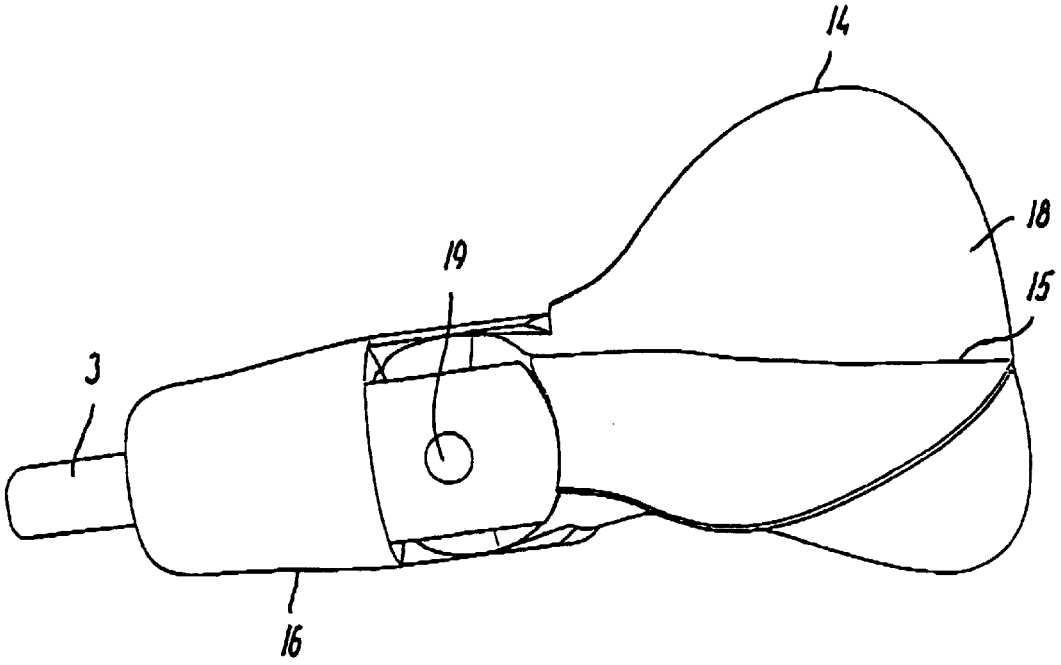

In the passive position shown in FIG. 6, in which the propeller shaft does not rotate, the blades extend axially rearwardly from the hub with the same side edge 15 of the two side edges 14, 15 of all the blades 1 facing each other.

In this embodiment the rear side edges 15 of the blades extend close to each other and thus to the axis of rotation in said passive position. Seen in an axial direction from behind, the blades extend almost radially from the pivot axis in the same manner as the feathers on the rear part of an arrow extend from the body of the arrow.

In the shown embodiment, the propeller blades move synchronously. The rear side edges 15 of all the blades therefore move simultaneously past the pivot axis and may be arranged so close to each other in this position that they almost "clip" past each other with a scissors' action.

Figure 7:
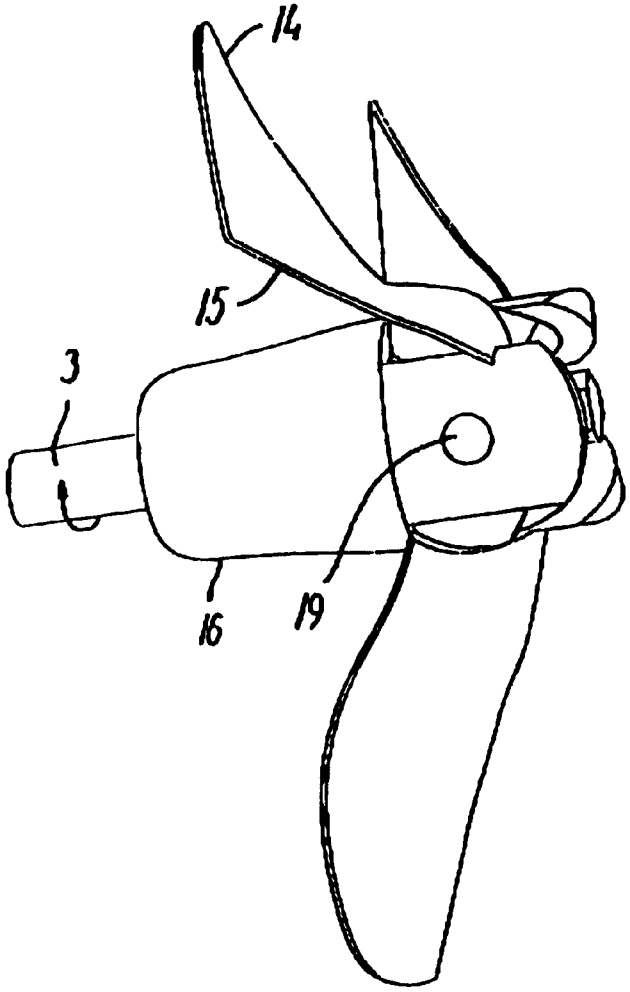

When the propeller begins to rotate in the direction shown by the arrow in FIG. 7 to propel the ship forwardly in the water, the propeller unfolds in exactly the same manner as in the first embodiment, and with the front edge 14 as the leading edge, as shown in FIG. 2.

If the propeller is rotated from the blade position shown in FIG. 6 in the direction shown by the arrow in FIG. 8 for navigation astern, the propeller likewise unfolds with the front edge 14 as the leading edge in the same manner as shown in FIG. 3 concerning the first embodiment.

If the blades are then folded together to the passive position from the blade position shown in FIG. 8, the blades maintain their orientation, and when the propeller is again caused to rotate in the direction shown by the arrow in FIG. 9, the rear edge 15 will now be the leading edge.

This phenomenon is illustrated schematically in FIGS. 11*a–e* in which the pivot axes of the blades intersect the axis of rotation of the propeller and are at right angles to the axis of rotation. FIG. 11*b* corresponds to FIG. 7 in which the ship sails ahead, and FIG. 11*c* corresponds to FIG. 8 in which the ship sails astern. In both cases the front edge is the leading edge. In FIGS. 11*d* and 11*e,* the blades have changed their orientation in the above-mentioned manner and now operate with the rear edge as the leading edge.

The applicant's DK patent application 0718/92, "a propeller having optimum efficiency in forward and rearward navigation", discloses a folding propeller in which the change in the shape of the blade profile when switching between forward and rearward navigation is utilized for imparting equally good properties to the propeller when sailing ahead and astern. The pitch ratio P/D, where P is the pitch and D the diameter, changes from the blade orientation shown in FIGS. 11*b,c* to the orientation shown in FIGS. 11*d,e.* Depending upon the configuration of the blade, the propeller can therefore change pitch ratio or gear. FIGS. 11*b,c* may thus by the low gear and FIGS. 11*d,e* the high gear.

The circumstance that the second embodiment of the propeller can change gear, is a considerable advantage, in particular when the propeller is used for an auxiliary engine for a sailing-ship. It will be an advantage here that the propeller can change to a higher gear when the engine is used as an aid when sailing by sail, since the noise on board may be reduced hereby, and fuel is saved.

The change of gears may take place in the following manner:

If an ordinary gear is desired for forward navigation, the ship goes ahead, followed by putting into neutral, and goes ahead again. If, on the other hand, a high gear is desired for forward navigation, the ship goes ahead, astern and ahead again.

As appears from the above explanation, the propeller always chooses the best position in an emergency situation, viz. a position of low pitch.

FIGS. 12*a–c* correspond to the first embodiment shown in FIGS. 1–5, in which the propeller blades can turn 360°. The ship goes ahead in FIG. 12*b* and astern in FIG. 12*c.* As mentioned before, this propeller cannot change gear in the same manner as the second embodiment of the propeller. The front edge of the blade will always be the leading edge, thereby providing the advantage that the propeller operates with the same good efficiency whether the ship goes ahead or astern.

The propeller of the invention is described in all the above cases on the assumption that the pivot axes of the blades intersected the propeller shaft and were perpendicular to it. FIGS. 13*a,e* show the second embodiment of the propeller of the invention, in which the pivot axes are now displaced in the plane of rotation, as shown. In FIGS. 13*b,c* the ship goes ahead and astern, respectfully, in low gear, and in FIGS. 13*d,e* ahead and astern, respectfully in high gear. The shown displacement of the pivot axes of the blades provides a reduction in the diameter when going ahead in low gear, whereas the diameter increases when going astern. The pitch diminishes concomitantly with the reduction in diameter, and conversely the pitch increases when the diameter increases.

In FIGS. 14*a–c,* the pivot axes of the blades are displaced in the same manner an shown in FIGS. 13*a–e* concerning the first embodiment. Although in this case the propeller does not change gear, the action of the propeller is affected in the same manner as stated above.

FIGS. 15*a–e* show the second embodiment of the propeller of the invention, where the pivot axes of the blades arm now inclined rearwardly with respect to a plane at right angles to the propeller axis. The pitch when going astern will always be smaller than when going ahead, while the reverse will always be the case if the pivot axes were inclined forwardly.

FIGS. 16*a–c* show the corresponding relationship for the first embodiment of the propeller.

As appears, the propeller of the invention may be constructed such that the front edge is always the leading edge, and can therefore operate with the same good efficiency when going ahead and astern. This is achieved by allowing the blades to turn freely 360° about their pivot axes.

When the pivot angle of the blades from the folded-together position is restricted, the orientation of the blades may be changed so that the propeller can advantageously switch from a low gear to a high gear.

It has been demonstrated with reference to FIGS. 11–16 how various changes in the position and orientation of the pivot axes with respect to the propeller axis may expediently be utilized according to the invention for imparting desired properties to the propeller. However, the positions and orientations of the pivot axes of the blades shown in FIGS. 11–16 just serve as examples and may advantageously be combined in many ways.

What is claimed is:

1. Folding propeller having a hub (2) and at least two propeller blades (1) which are pivotally mounted in the hub (2) about pivot axes (13), said pivot axes extending outwards from a central area in the hub (2) and being disposed in a plane which is at right angles to the axis of rotation of the propeller, said blades (1) being pivotable about their pivot axes between unfolded, radially protruding operating positions in which the propeller during rotation propels the ship through the water, and one passive position in which the shaft does not rotate, and in which the blades extend axially rearwards in extension of the hub (2) with the same side edge (15) of the two side edges (14, 15) of the blades (1) facing each other, and wherein said blades (1) are adapted to pass each other in said passive position, so that the blades are movable to both sides of the passive position.

2. A folding propeller according to claim 1, wherein said one side edge (15) of all the blades (1) faces the pivot axis.

3. A folding propeller according to claim 1, wherein the rear edges (15) of the blades (1) face each other.

4. A folding propeller according to claim 1, wherein each blade has an elongate configuration extending substantially transversely to its pivot axis.

5. A folding propeller according to claim 1, wherein the pivot axes of the blades intersect the axis of rotation of the propeller.

6. A folding propeller according to claim 1, wherein the pivot axes of the blades are tangent to a circle having its centre at the axis of rotation of the propeller.

7. A folding propeller according to claim 1, wherein the pivot axes of the blades are disposed in a cone having a center of revolution coinciding with the axis of rotation of the propeller.

8. A folding propeller according to claim 1, wherein the blades (1) are retained in the hub (2) for mutual synchronized movement about their pivot axes (13).

9. A folding propeller according to claim 8, wherein in the area around their pivot axes (13) the blades (1) are provided with toothed portions (11, 24) which cooperate with a common rotatable, axially mounted conical gear wheel (10, 23).

* * * * *